United States Patent [19]

Sbabo

[11] 4,142,558

[45] Mar. 6, 1979

[54] DEVICE FOR TUCKING, RETAINING AND CURLING THE WEFT AND TO PROVIDE A SELVEDGE OF A WOVEN FABRIC

[76] Inventor: Silvio Sbabo, Via Romana Rompato, 6, Schio (Province of Vincenza), Italy

[21] Appl. No.: 816,780

[22] Filed: Jul. 18, 1977

[30] Foreign Application Priority Data

Jul. 30, 1976 [IT] Italy ..... 41634 A/76

[51] Int. Cl.[2] ..... D03D 47/48

[52] U.S. Cl. ..... 139/434; 139/302

[58] Field of Search ..... 139/302, 303, 430, 434, 139/453

[56] References Cited

U.S. PATENT DOCUMENTS

| | | | |
|---|---|---|---|
| 3,111,966 | 11/1963 | Demuth | 139/434 |
| 3,563,280 | 2/1971 | Cugini | 139/434 |
| 3,951,177 | 4/1976 | Santucci | 139/434 |
| 4,031,925 | 6/1977 | Santucci | 139/302 |
| 4,040,452 | 8/1977 | Santucci | 139/434 |

*Primary Examiner*—Henry Jaudon

*Attorney, Agent, or Firm*—Guido Modiano; Albert Josif

[57] ABSTRACT

A device for cutting, retaining and tucking a weft end to form a selvedge comprises two concurrently operated cutting blades, a shoe associated with the blades and releasably retaining the cut yarn, a pick up hook adapted to tuck the yarn into the weft shed and cam actuators and linkages to sequentially control the yarn cutting and reinsertion operations.

3 Claims, 5 Drawing Figures

DEVICE FOR TUCKING, RETAINING AND CURLING THE WEFT AND TO PROVIDE A SELVEDGE OF A WOVEN FABRIC

BACKGROUND OF THE INVENTION

This invention relates to a device for cutting, retaining and tucking the weft end to provide a selvedge along the yarn feeding side of a woven fabric.

Known are various devices for application to shuttleless looms, which are intended to cut and retain the weft yarn to allow successive tucking thereof in order to form the selvedge.

Such prior art devices substantially comprise a cutting assembly, between the blades whereof the weft yarn is brought by a driven gripper.

That cutting assembly cuts the yarn and retains it by means of an elastic device, usually a spring, until a hook picks it up and tucks it into the shed.

Other devices designed to perform that same operation employ pneumatic means, such as air suction nozzles, to retain the cut yarns.

Both approaches, however, are not free of operational drawbacks and constructional complexity.

In particular the last-mentioned devices, employing suction air, are not very effective and are hardly suitable for pneumatically separating the weft ends.

By contrast, the former while providing a satisfactory yarn cutting and retaining action, by the very reason of its retaining the yarn through the continued action of an elastic pressure means, has a tendency to foul very quickly.

In fact, particularly with hairy yarns, as the cut end is picked up by the hook, it is withdrawn from a retaining means which keeps exerting its pressure without opening.

The resulting effect is that part of the yarn remains jammed in the pick up member, thus forming within a short time a hair staple which impairs the device proper operation.

At this time, it becomes necessary to stop and clean the machine.

A further drawback comes from the fact that no provision is made for generally adjusting the cutting device to suit the type of yarn, the slay reed movement and the temple position.

Another difficulty originates from the fact that all the movements of these devices are normally actuated by means of spring biassed cams; owing to the high speed reached by modern looms, the biassing springs are in fact so highly strained that their operation is sometimes critical and unreliable, such as to undergo frequent failure.

SUMMARY OF THE INVENTION

It is a primary object of this invention to obviate the drawbacks mentioned above by providing a fully mechanical cutting device of simple and reliable operation.

It is another object of the invention to minimize any maintenance problems, by preventing the formation of an undesirable hair or thread build up in the retaining member.

A further object is to provide such a device allowing a most complete and simple positioning with respect to the fabric being woven.

A further object is to eliminate the biassing springs from the actuating cams, such as to provide a device permitting high processing speeds.

These and other objects, such as will be better understood hereinafter, are achieved by a device for cutting, retaining and tucking a weft end to form a selvedge, according to this invention, characterized in that it comprises two concurrently operated cutting blades, a shoe associated with said two cutting blades and releasably retaining the cut yarn, a pick up hook adapted to bring said yarn back through the weft shed, positive cam actuators and linkages operative to sequentially control the yarn cutting and re-insertion operations and means for independently positioning the cutting assembly.

BRIEF DESCRIPTION OF THE DRAWINGS

Further features and advantages of this invention will be apparent from the following description of a preferred but not restrictive embodiment thereof, illustrated by way of example and not of limitation in the accompanying drawings, where:

FIG. 5 shows a variation to the rotary movement of the pick up hook shaft.

DESCRIPTION OF THE PREFERRED EMBODIMENTS

Figure 1:
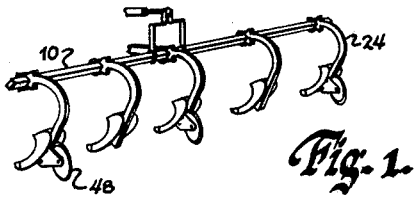
FIG. 1 is a side perspective view of the instant cutting device and of the housing or box containing the actuating system.

Making reference to the cited figures, there is indicated at 1 the front of a loom whereto an inverted-"T" bracket, having a horizontal wing 2 and vertical wing 20, is attached, as by means of screws and joints not shown.

To the horizontally extending wing 2, 2, on the right-hand side when the device is viewed frontally, a second "L" bracket is attached, the horizontal portion 8*a* whereof is affixed to said horizontal wing 2 by means of set screws 3 penetrating slotted holes 4 such as to permit said "L" bracket to be positioned by effecting movements normal to the weaving direction.

Between said vertical wing 20 and the vertical portion 8*b* of said "L" bracket, there is inserted an actuating mechanism box or housing 5 also providing support for the cutting device 6 proper and the pick up hook 7.

To the vertical portion 8*b* of said "L" bracket is affixed, by means of a pin 9 and locking screw 10, the cover of the temple 11 which in its adjustment translatory movements is rigid with said "L" bracket.

In particular, said actuating mechanism box or housing 5 may be further adjusted through a cam 12 which rotates in a bore 13 and engages with a seat formed in the box or housing wall to impart a back-and-forth movement along a line extending normal to the loom.

In order to definitely lock said housing 5 onto said bracket 2, three screws 14 are provided which engage in said housing 5 and act with their heads on said bracket 2 and are passed through slotted holes 15 which allow for adjustment upon loosening the screws. A shaft 16, whereby the inner mechanism is driven, projects outwardly from said housing 5 and carries keyed thereto a driven gear 17 which is locked in place by a clamp device 18. A driving gear 19 is journaled to the bottom portion of the right-hand outer wall 20 of said inverted "T" bracket, to mesh from below with a pinion gear in the breast beam 1, not shown in the drawings.

In order to kinematically connect said driving gear 19 and driven gear 17, a jockey 21 is interposed the rotation axis whereof may be shifted by loosening and retightening the nut 23 of a bolt acting as the pivot pin, the head 22 whereof is movable in an arcuate seat 24 being curved concentrically with said driving gear 19.

Said temple 11 cover is supported by an arm 25 secured, as mentioned above, to a pin 9 and may be adjusted for distance away from the template by means of a through screw 26 located on said arm 25 at the cited locking screw 10 whereon it is active.

The cutting device 6 comprises two "L" levers, respectively a lower one 27 and upper one 28, journaled on a common shaft 29, one adjacent the other. Said shaft 29 may be displaced vertically, in that it terminates in a screw and nut 30 across the wall of said box or housing 5 through a vertical slot 31 with set screw 32.

Figure 3:
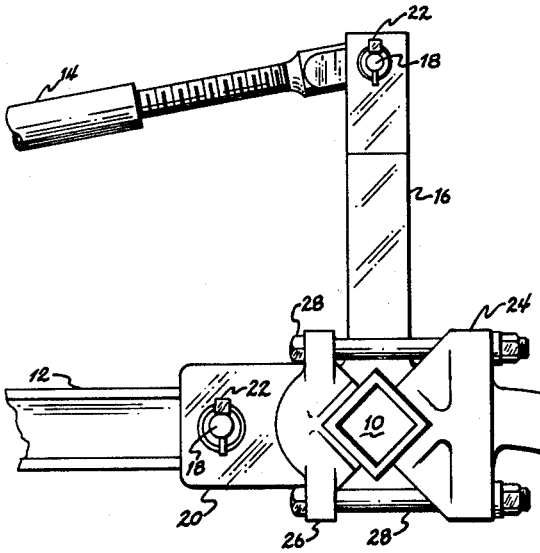
FIG. 3 shows in perspective the cutting device proper.
Figure 3:
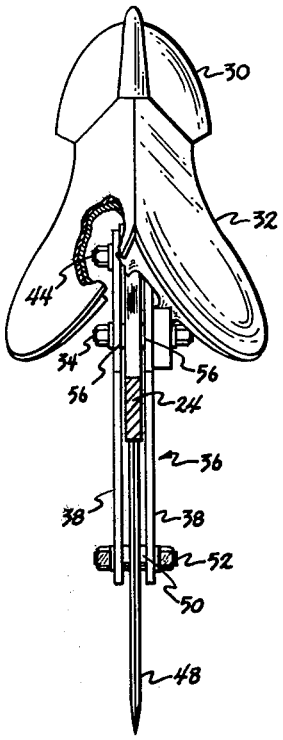

The shaping of said "L" levers is such that their middle portions between the arms projecting out of said box 5 move in a common plane, being guided by a jutting support 33 associated with said box 5 and having a substantially vertical seat for the movements of the levers 34. The lower lever 27 has at its end portion a lower cutting blade 35 (FIG. 3) interacting with an upper cutting blade 36 associated with said lever 28.

Arranged between said lower blade 35 and said lever 27 is a bearing plate 37 substantially parallel to and adjacent said blade 35 whereon it bears, a mating retaining shoe 38 being effective to retain the cut yarn.

From the foregoing it will be understood that the bearing plate 37 and the lower cutting blade 35 have common supporting means 27. Said retaining shoe 38 moves vertically substantially parallel to said upper blade 36, its stem 39 being accomodated in a vertical seat formed in the head of said lever 28 and urged downwardly beyond the cutting edge of blade 36 (FIG. 3) by a spring 40 interacting between a jut 41 rigid with said lever 28 and a stop 42 associated with said stem 39. From the foregoing it will be appreciated that the shoe 38 and the upper blade 36 have common support means 28.

Figure 4:
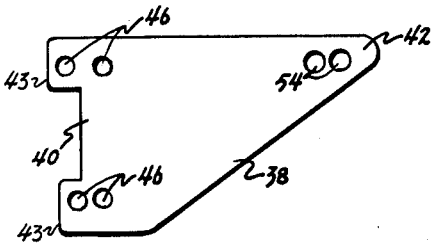
FIG. 4 is a ghostline view of the housing containing the actuating mechanism.
Figure 2:
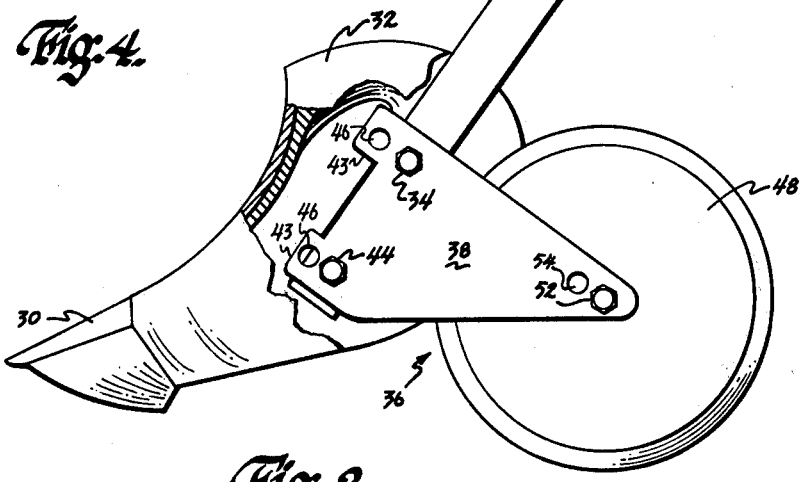
FIG. 2 shows the adjusting and positioning means for the instant cutting device.

FIG. 4 shows the actuators for operating the device. In particular, the cited shaft 16 has within said box 5 several grooves 43 adapted to engage with a pair of positive cams, respectively **44*a* and 44*b*, for actuating the cutting device, and 45*a*, 45*b* for actuating said pick up hook 7. More specifically, the pair 44*a* and 44*b*, through two first straight levers, respectively 46*a* and 46*b*, which follow their respective cams by means of feelers, drive two connecting rods 47*a* and 47*b* the second end whereof is associated to the "L" levers of the cutting device, respectively 28 and 27**.

Similarly, the motion is transferred to the pick up hook 7 via two kinematic trains, respectively comprising a first lever 48 directly actuated by the cam **45*a*, which through a connecting rod 49 and second lever 50 causes the supporting shaft 51 carrying said pick up hook 7 to move through a yoke 52, engaging floatingly in a groove 53 rigid with the shaft 51. To control the rotation of said pick up hook 7, the second kinematic train consists of a first lever 54 operating, through multiple linkages 55, 56, 57, an internally grooved sleeve 58 engaging floatingly without restricting movement on mating bosses 59 present on said supporting shaft 51**.

FIG. 5 shows a variation to the actuators for rotating said pick up hook 7, where the lever 56 reciprocates, through a connecting rod 60 of small size, a rack 61 meshing with a pinion 62 keyed to said sleeve 58.

The operation of the inventive cutting device may be easily inferred from the above description: in particular, the yarn to be cut is caused to pass between the two open blades which, on moving simultaneously with a scissor-like movement, initially block it under the influence of the shoe 38 on the bearing plate 37 and then cut it. At this point, by concurrent action of the actuating cams, the cutting assembly is lowered, while retaining the yarn, until the latter is engaged by the pick up hook 7. Subsequent to this, the device opens fully to release the yarn which. Thus the yarn is no longer torn by the pick up member as in conventional devices and, leaves no hair deposit or the like.

It should be further noted that the adjusting devices allow a proper overall adjustment of each member, thereby the temple may be correctly positioned with respect to the slay reed, irrespective of the cutting device. Moreover the latter may be displaced back and forth as well as up and down depending on the yarn being used.

Thus, the invention objects have been achieved by providing a fully mechanical type of device equipped with positive cams, and avoiding the necessity for cam biassing springs, which accordingly allows high processing speeds and affords reduced maintenance time.

Obviously, based upon the same inventive concept, many modifications and variations become possible, as partly mentioned herein, all of which fall within the scope of this application.

In particular, the materials, dimensions and arrangements may be selected according to specific requirements.

I claim:

1. A device for cutting, retaining and tucking a weft end to form a selvedge, comprising a cutting assembly including two concurrently operated cutting blades, a yarn retaining assembly cooperating with the two cutting blades to retain the cut yarn, a pick up hook assembly adapted to tuck said yarn into the weft shed, positive cam actuators and linkages operative to sequentially control the yarn cutting and tucking operations, a housing containing said cam actuators and linkages, a first bracket member for supporting said housing and means for independently positioning the cutting assembly, wherein according to the improvement said yarn retaining assembly comprises a shoe member and a bearing plate cooperating therewith, said shoe member and one of said cutting blades having common support means, said shoe member being slidable in said common support means parallel to said cutting blades, said shoe member having spring means normally urging the shoe member beyond the cutting edge of said one cutting blade, and wherein said bearing plate and the other of said two cutting blades have common supporting means, said other of said two cutting blades having adjacent thereto said bearing plate facing said shoe member to clamp the yarn therebetween when the two cutting blades and the respective shoe member and the bearing plate are approached to one another and retain it during the cutting action of the blades.

2. A device according to claim 1, further comprising a second bracket member which supports said cutting assembly connected to said first bracket member, said second bracket member having means for adjustably securing thereto a supporting arm for a temple cover to adjust the distance between the temple and the cover, said securing means comprising a pin on one end of said supporting arm for rotatable engagement with said second bracket member and locking screw means in cooperation with said second bracket member at a distance from said pin for adjusting the angular position of said supporting arm, and a set screw means acting between said arm and said locking screw means.

3. A device according to claim 2, wherein said second bracket member has slotted holes for screw means allowing adjustable connection with said first bracket member for adjustment thereof with respect to said cutting means supporting first bracket member.

* * * * *